US007455604B2

(12) United States Patent
Li

(10) Patent No.: US 7,455,604 B2
(45) Date of Patent: Nov. 25, 2008

(54) HEIGHT ADJUSTING DEVICE FOR USE IN STRING PULLING BLOCK OF STRINGING MACHINE

(75) Inventor: Tsai-Tien Li, Kaohsiung (TW)

(73) Assignees: Chun-Chieh Li, Kaohsiung (TW); Po-Hsiu Lin, Taipei (TW)

( * ) Notice: Subject to any disclaimer, the term of this patent is extended or adjusted under 35 U.S.C. 154(b) by 0 days.

(21) Appl. No.: 11/845,899

(22) Filed: Aug. 28, 2007

(65) Prior Publication Data

US 2008/0167147 A1 Jul. 10, 2008

(30) Foreign Application Priority Data

Jan. 9, 2007 (TW) ..... 96100848 A

(51) Int. Cl.
*A63B 51/14* (2006.01)

(52) U.S. Cl. ..... 473/557

(58) Field of Classification Search ..... 473/555–557
See application file for complete search history.

(56) References Cited

U.S. PATENT DOCUMENTS 4,249,732 A * 2/1981 Balaban ..... 473/556
4,326,713 A * 4/1982 Balaban ..... 473/556
4,417,729 A * 11/1983 Morrone ..... 473/556
5,568,921 A * 10/1996 Lorentzen et al. ..... 473/556
5,908,362 A * 6/1999 Carr ..... 473/557
6,984,185 B2 * 1/2006 Nakane et al. ..... 473/556
7,144,342 B1 * 12/2006 Van Der Pols ..... 473/557
2005/0096160 A1 * 5/2005 Nakane et al. ..... 473/557

* cited by examiner

*Primary Examiner*—Raleigh W. Chiu
(74) *Attorney, Agent, or Firm*—Alan Kamrath; Kamrath & Associates PA

(57) ABSTRACT

A height adjusting device for use in a string pulling block of a stringing machine includes a rod member combining with a string pulling block of the stringing machine for moving relative to the rod member. A tilted coupling seat is mounted on the upper side of a base of the stringing machine. The tilted coupling seat includes a rail arranged thereon and with which the rod member is axially connected for moving along the rail. Thus, a string inserted between a frame and a string puller of the string pulling block is in a horizontal state, thus avoiding friction of the frame and the string to protect the string and the frame from harm.

6 Claims, 8 Drawing Sheets

HEIGHT ADJUSTING DEVICE FOR USE IN STRING PULLING BLOCK OF STRINGING MACHINE

BACKGROUND OF THE INVENTION

1. Field of the Invention

The present invention relates to a height adjusting device for use in a string pulling block of a stringing machine that may improve the stringing quality and facilitate the height adjustment of the string pulling block.

2. Description of the Prior Arts

Tennis and badminton are both healthy and intellectual sports. To develop the skill of playing tennis or badminton, a racket and strings with a precise pound number are both indispensable winning factors in a tennis or badminton game. Besides, the stringing method of the racket also influences the service lives of the racket and strings.

A prior art stringing machine comprises a base a, a holder b and a string pulling block c (as shown in FIG. 1). The holder b is axially connected to the top of the base a for 360 degree rotation and positioning. The string pulling block c includes a string puller c1 and a lever c2 both arranged thereon. A rod member 10 for combining with the string pulling block c is coupled onto the upper side of the base a (as illustrated in FIG. 2) and includes racks 101 arranged thereon, such that the string pulling block c may move along the racks 101. In other words, the string pulling block c may move relative to the rod member 10.

In operation, the frame d is supported by the holder b, and the string e is fixed between the string puller c1 of the string pulling block c and the frame d (as shown in FIG. 2). Thereafter, the pound number of the string e is set. By rotating the lever c2, the set pound number of the string e is achieved, thereby assembling the longitudinal and lateral strings e of the frame d in turns.

However, such a prior art stringing machine still has the following defects:

1. Easily harming the frame d and the string e: Since the various kinds of frames d are not provided with the same thickness and the heights of the holders b and the string pulling blocks c are fixed, inserting the string e between the string puller c1 of the string pulling block c and the frame d causes an included angle θ therebetween (as illustrated in FIG. 2). Hence, when pulling the string e, the force of the frame d is unequal because of friction, obtaining an imprecise pound number. Furthermore, the string e or the frame d is easily broken because of friction between the through holes formed in the frame d and the string e.

2. Disadvantageous operation: Since the various kinds of frames d are not provided with the same thickness and the heights of the holders b and the string pulling blocks c are fixed, during the rotation of the frame d, a grip d1 of the frame d contacts with the string puller c1 (as illustrated in FIGS. 3 and 4), resulting in an disadvantageous operation.

The present invention has arisen to mitigate and/or obviate the afore-described disadvantages.

SUMMARY OF THE INVENTION

The primary object of the present invention is to provide a height adjusting device for use in a string pulling block of a stringing machine that may protect strings and a frame from harm.

Another object of the present invention is to provide a height adjusting device for use in a string pulling block of a stringing machine that may avoid contact of the frame and a string puller during the rotation of the frame.

In accordance with one aspect of the present invention, a height adjusting device for use in a string pulling block of a stringing machine comprises a rod member and a coupling seat. The stringing machine includes a base, a holder and a string pulling block (its structure is the same as above-mentioned description, therefore further remarks would be omitted).

The rod member is constructed in the form of an elongated plate for combining with the string pulling block and includes racks arranged thereon. Thus, the string pulling block may move along the racks. The rod member includes a tilted sliding member, a cross section of which is in the shape of an inverted U. The tilted sliding member is coupled at one end of the rod member and has two biasing tabs disposed at the cater-cornered sides thereof.

A tilted coupling seat is mounted on the upper side of the base of the stringing machine and includes a rail arranged thereon. By using the sliding member, the rod member is axially connected with the rail for obliquely moving along the rail upward and downward, thus adjusting the height of the string pulling block. In addition, the coupling seat includes two side plates corresponding to each other and used to receive the rail therein such that the sliding member may be limited to slide on the rail between the two side plates of the sliding member. One of the side plates contains a micro-adjustable screw screwed therein, and another of the side plates involves an adjusting screw screwed therein. The micro-adjustable screw and the adjusting screw are in response to the biasing tabs of the sliding member individually.

In assembly, a frame is supported by the holder, and a string is fixed between a string puller of the string pulling block and the frame. Thereafter, the pound number of the string is set. Since the string is in an extension state, the sliding member of the rod member obliquely moves upward by way of the string pulling block, thereby the string inserted between the frame and the string puller is almost in a horizontal state. One of the biasing tabs abuts against the micro-adjustable screw of the coupling seat. Then, the micro-adjustable screw is rotated for providing a micro adjustment to let the string become horizontal. Finally, by rotating a lever, the set pound number of the string is obtained, thus assembling the longitudinal and lateral strings e of the frame d in turns.

If by turning the frame to face the string results in the string outside the frame becoming loose, the sliding member obliquely and downwardly moves toward another biasing tab which is biased against the adjusting screw of the coupling seat. To avoid a grip contacting with the string puller of the string pulling block during the rotation of the frame, the adjusting screw is rotated. Simultaneously, the heights of the sliding member, the rod member and the string pulling block are descended without causing the grip to contact with the string puller, facilitating rotation in different directions.

The present invention will become more obvious from the following description when taken in connection with the accompanying drawings, which show, for purpose of illustration only, the preferred embodiment in accordance with the present invention.

DETAILED DESCRIPTION OF THE PREFERRED EMBODIMENT

Figure 1:
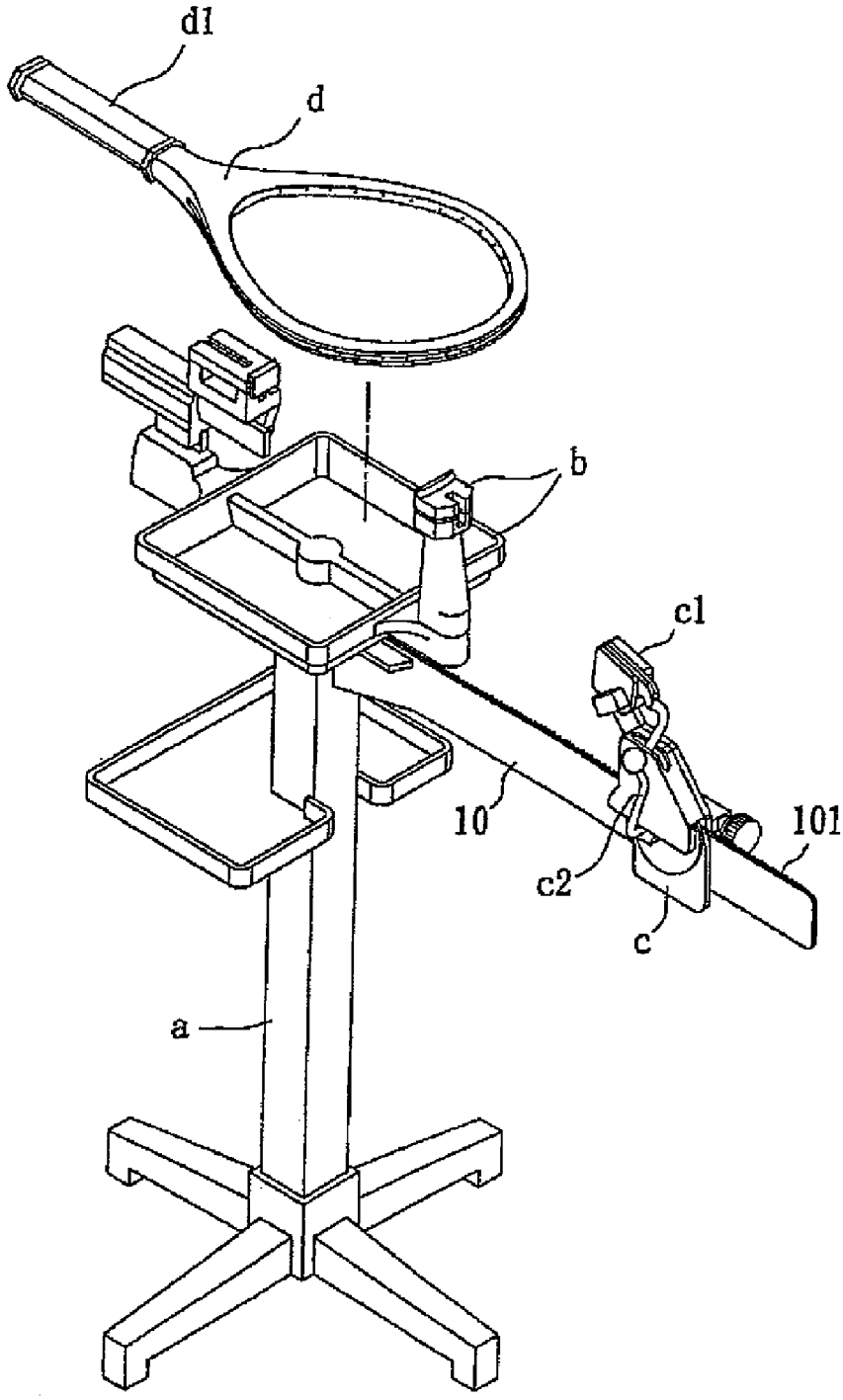
FIG. 1 PRIOR ART
FIG. 1 is a perspective diagram illustrating the exploded components of a prior art stringing machine.
Figure 2:
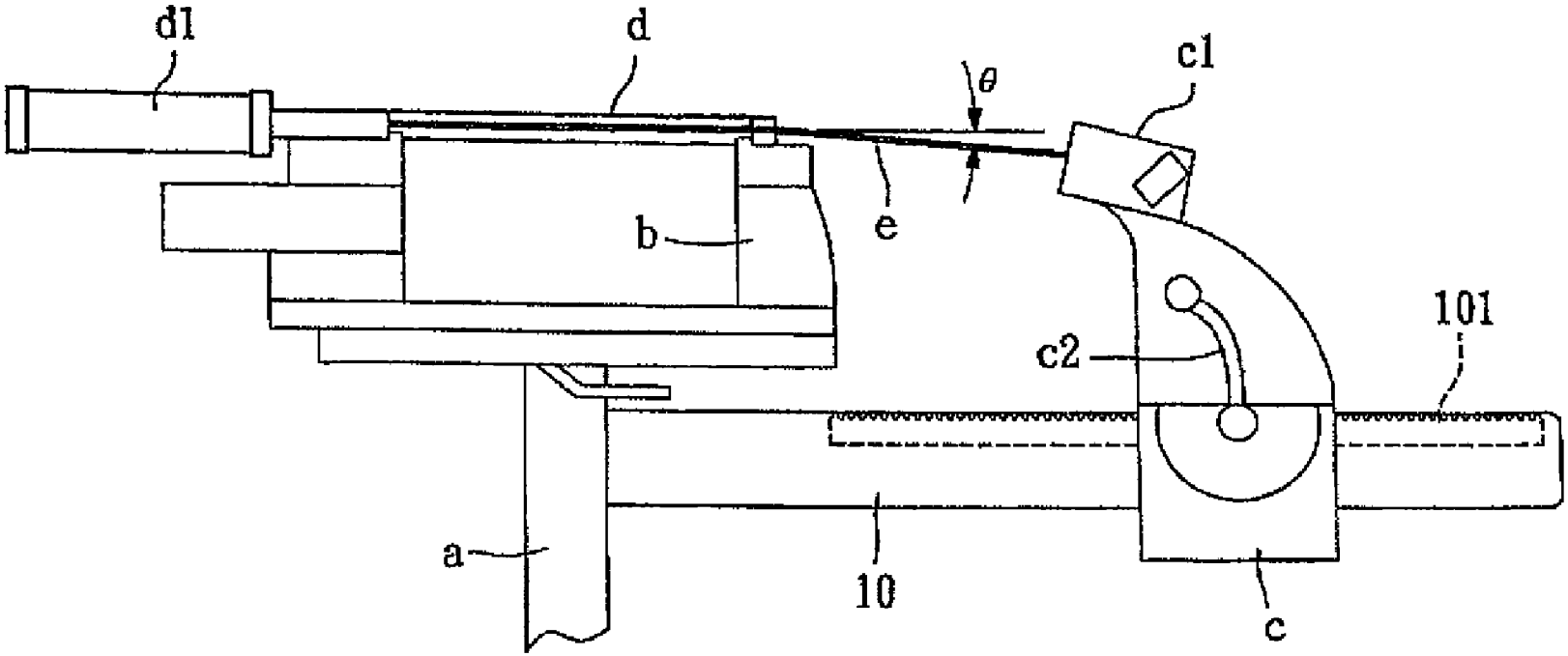
FIG. 2 PRIOR ART
FIG. 2 is a side diagram illustrating an angle occurring between a frame of the prior art stringing machine and a string.
Figure 3:
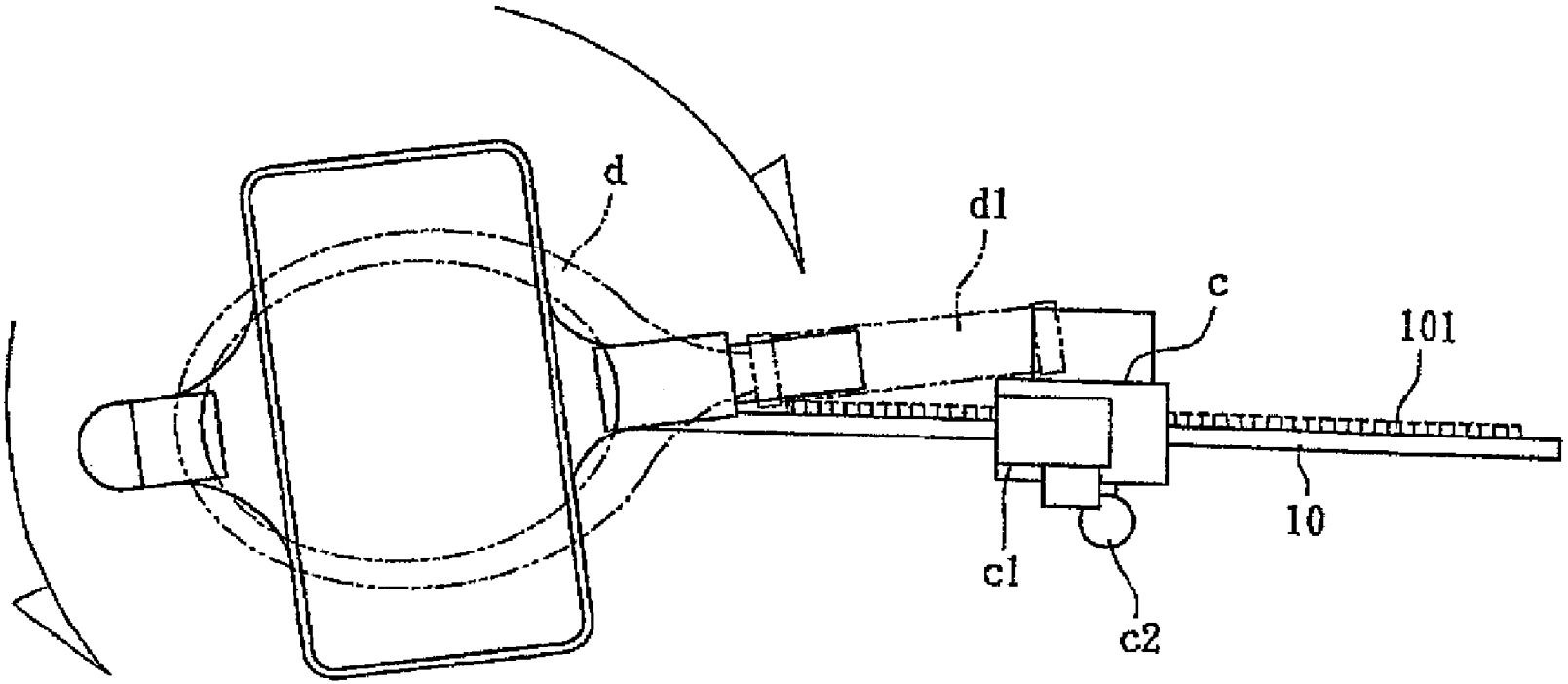
FIG. 3 PRIOR ART
FIG. 3 is a top plane diagram illustrating a grip contacting with a string puller of a string pulling block after the rotation of the frame of the prior art stringing machine.
Figure 4:
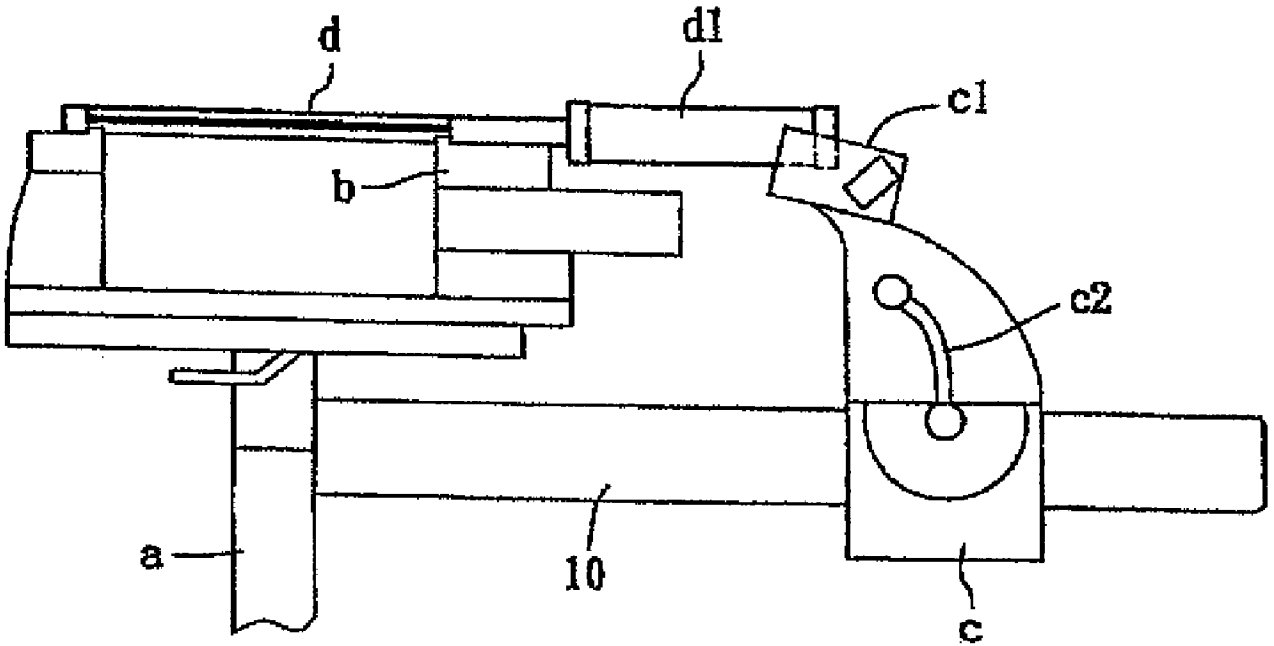
FIG. 4 PRIOR ART
FIG. 4 is a side diagram according to FIG. 3.
Figure 5:
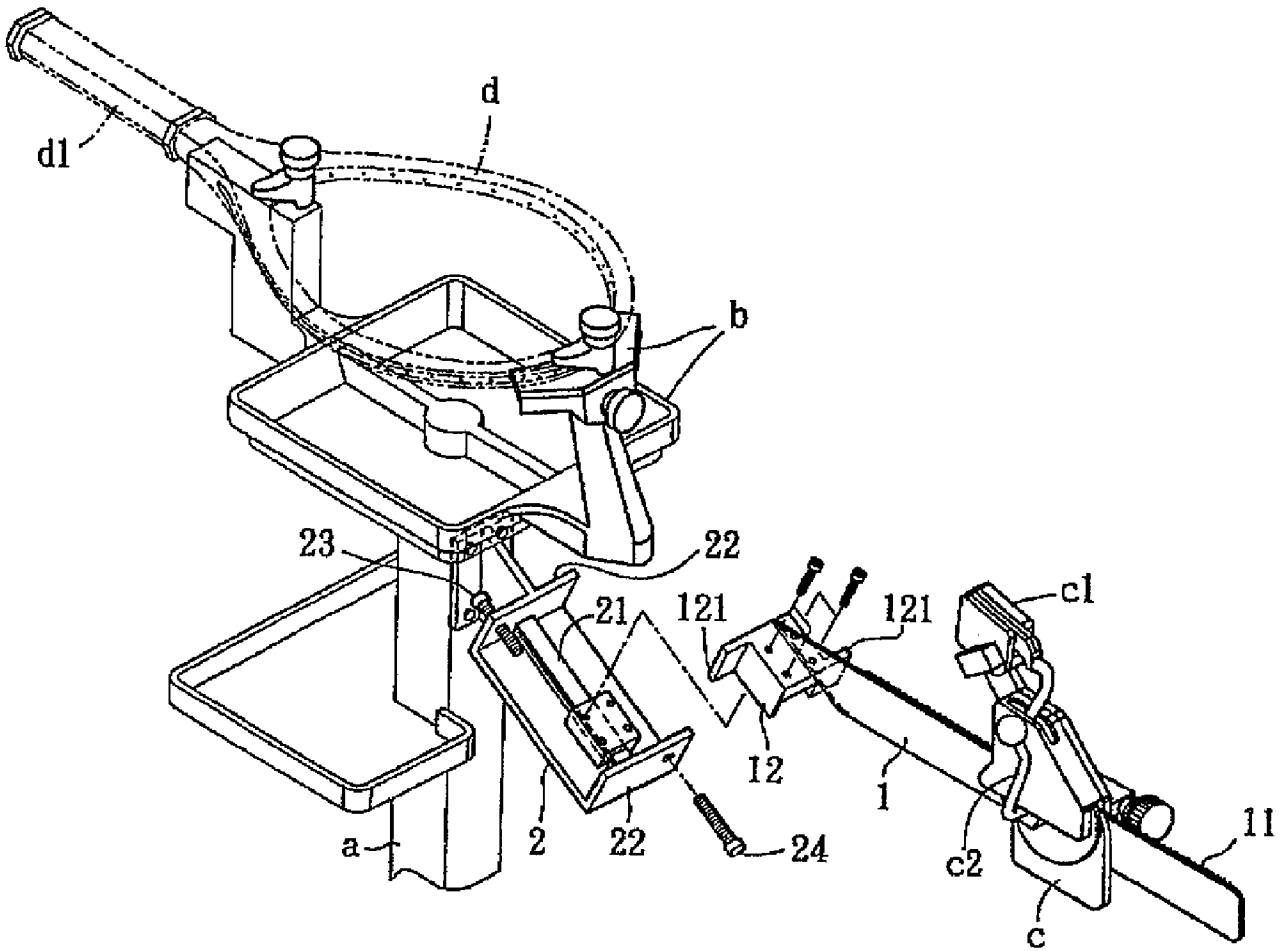
FIG. 5 is a perspective diagram illustrating the exploded components of a height adjusting device for use in a string pulling block of a stringing machine according to the present invention.

Referring to FIG. 5, a height adjusting device for use in a string pulling block of a stringing machine in accordance with the present invention comprises a rod member 1 and a coupling seat 2. The stringing machine includes a base a, a holder b and a string pulling block c (its structure is the same as above-mentioned description, therefore further remarks would be omitted).

Figure 6:
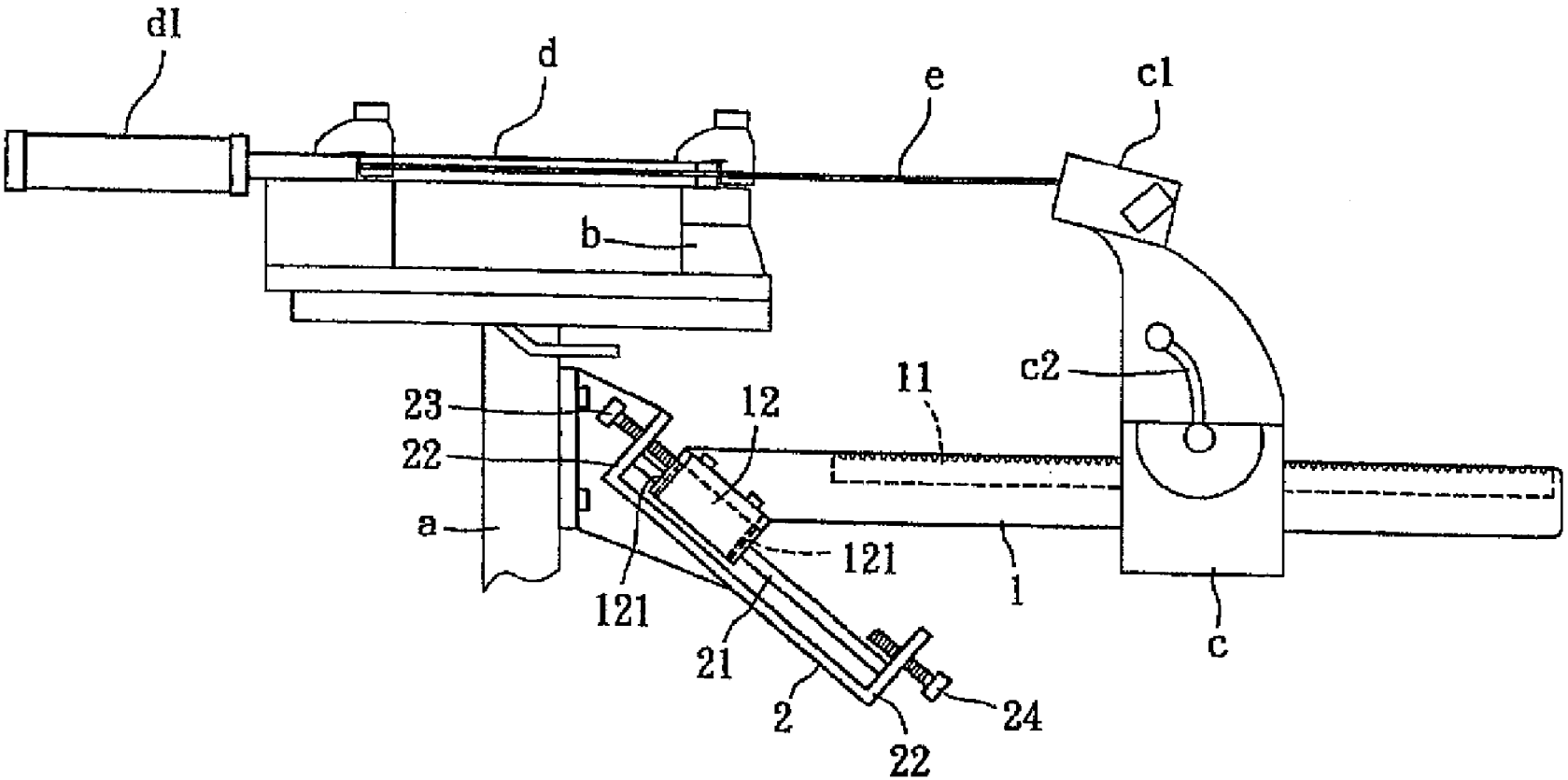
FIG. 6 is an assembly side diagram illustrating a rod member of the height adjusting device for use in a string pulling block of a stringing machine according to the present invention moving upward.

The rod member 1 (as shown in FIGS. 5 and 6) is constructed in the form of an elongated plate for combining with the string pulling block c and includes racks 11 arranged thereon. Thus, the string pulling block c may move along the racks 11. The rod member 1 includes a tilted sliding member 12, a cross section of which is in the shape of an inverted U. The tilted sliding member 12 is coupled at one end of the rod member 1 and has two biasing tabs 121 disposed at the cater-cornered sides thereof (as illustrated in FIG. 5).

Figure 7:
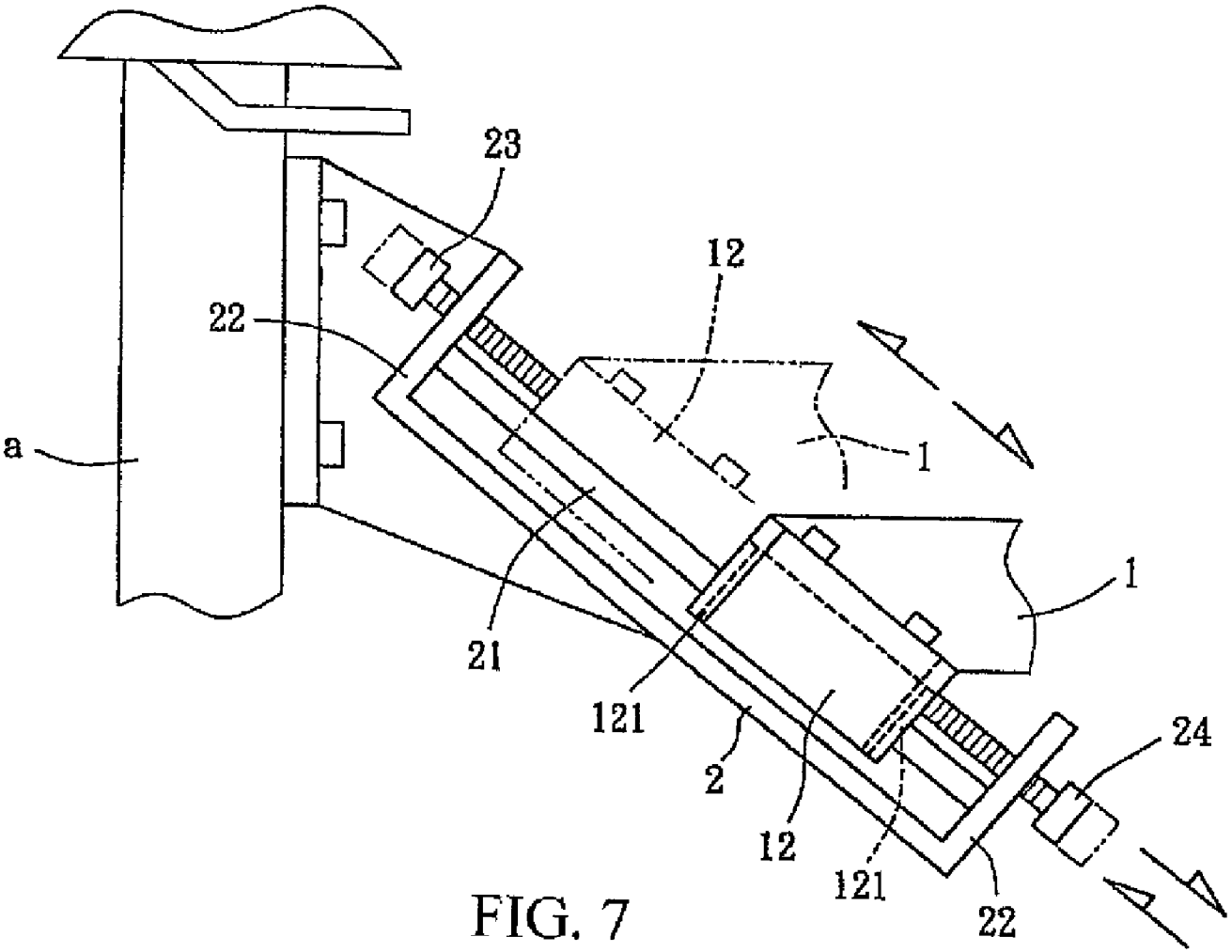
FIG. 7 is an operational side diagram of the height adjusting device for use in a string pulling block of a stringing machine according to the present invention.

A tilted coupling seat 2 (as shown in FIGS. 5 and 6) is mounted on the upper side of the base a of the stringing machine and includes a rail 21 arranged thereon. By using the sliding member 12, the rod member 1 is axially connected with the rail 21 for obliquely moving along the rail 21 upward and downward (as illustrated in FIG. 7), thus adjusting the height of the string pulling block c. In addition, the coupling seat 2 includes two side plates 22 corresponding to each other and used to receive the rail 21 therein such that the sliding member 12 may be limited to slide on the rail 21 between the two side plates 22 of the sliding member 12. One of the side plates 22 contains a micro-adjustable screw 23 screwed therein, and another of the side plates 22 involves an adjusting screw 24 screwed therein. The micro-adjustable screw 23 and the adjusting screw 24 are in response to the biased tabs 121 of the sliding member 12 individually.

In assembly, a frame d is supported on the holder b, and a string e is fixed between a string puller c1 of the string pulling block c and the frame d (as shown in FIG. 6). Thereafter, the pound number of the string is set. Since the string e is in an extension state, the sliding member 12 of the rod member 1 obliquely moves upward by way of the string pulling block c. Thus, the string e inserted between the frame d and the string puller c1 is almost in a horizontal state. One of the biasing tabs 121 abuts against the micro-adjustable screw 23 of the coupling seat 2. Then, the micro-adjustable screw 23 is rotated for providing a micro adjustment to let the string e become horizontal. Finally, by rotating a lever c2, the set pound number of the string e is obtained, thus assembling the longitudinal and lateral strings of the frame d in turns.

Figure 8:
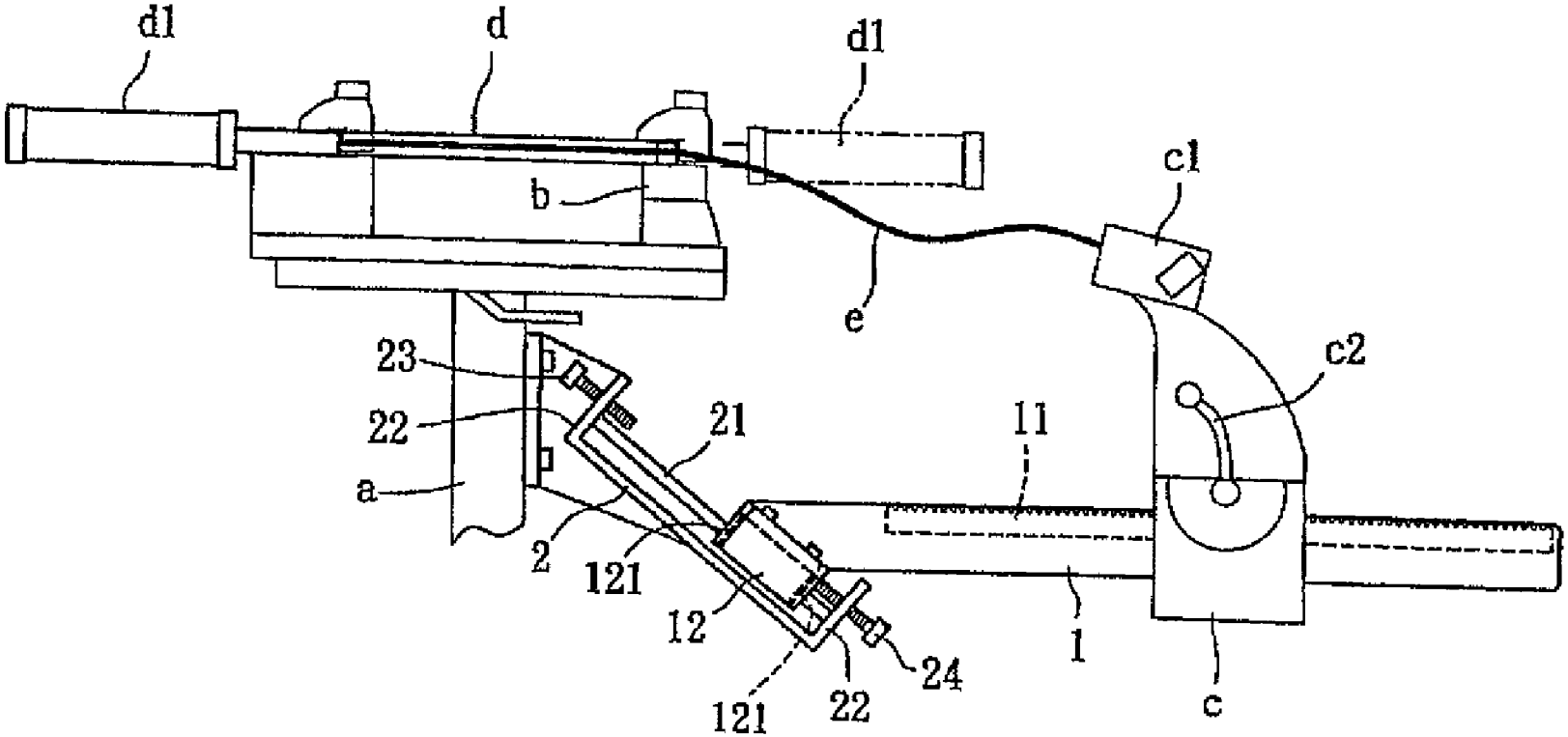
FIG. 8 is an assembly side diagram illustrating the rod member of the height adjusting device for use in a string pulling block of a stringing machine according to the present invention moving downward.

If by turning the frame d to face the string e results in the string e outside the frame d becoming loose, the sliding member 12 obliquely and downwardly moves toward another biasing tab 121 which is biased against the adjusting screw 24 of the coupling seat 2 (as shown in FIG. 8). To avoid a grip d1 contacting with the string puller c1 of the string pulling block c during the rotation of the frame d, the adjusting screw 24 is rotated. Simultaneously, the heights of the sliding member 12, the rod member 1 and the string pulling block c are descended without causing the grip d1 to contact with the string puller c1, facilitating rotation in different directions.

It can be clearly seen from the preceding accounts on the features of the present invention that the height adjusting device for use in a string pulling block of a stringing machine of the present invention has the following advantages:

1. Protecting the string e and the frame d from harm: Since the heights of the rod member 1 and the string pulling block c may be adjustable to move at different heights relative to the frame d, the string e inserted between the frame d and the string puller c1 is in a horizontal state. In other words, no angle occurs between the frame d and the string e, thus avoiding contact of the string e and the through holes formed in the frame d and friction of the frame d and string e.

2. Avoiding contact of the frame d and the string puller c1 during the rotation of the frame d: By rotating the adjusting screw 24 backward, the heights of the sliding member 12, the rod member 1 and the string pulling block c may be further descended, and the grip d1 doesn't contact with the string puller c1 of the string pulling block c, facilitating rotation in different directions.

On the other hand, micro adjustments of the heights of the sliding member 12, the rod member 1 and the string pulling block c may be achieved by an electronic controlling system, causing a precise position.

The invention is not limited to the above embodiment but various modifications thereof may be made. It will be understood by those skilled in the art that various changes in form and detail may made without departing from the scope and spirit of the present invention.

What is claimed is:

1. A height adjusting device for use in a stringing machine comprising:

a rod member combining with a string pulling block of the stringing machine for moving relative to said rod member; and a tilted coupling seat mounted on a upper side of a base of the stringing machine, wherein said coupling seat includes a rail arranged thereon, with said rod member axially connected to the tilted coupling seat for moving along said rail, thereby adjusting the height of said string pulling block.

2. The height adjusting device for use in a stringing machine as claimed in claim 1, wherein said rod member includes a tilted sliding member, a cross section of which is in a shape of an inverted U, with the sliding member coupled at one end of the rod member and limited to slide on said rail.

3. The height adjusting device for use in a stringing machine as claimed in claim 2, wherein said tilted sliding member includes two biasing tabs disposed at cater-cornered sides thereof.

4. The height adjusting device for use in a stringing machine as claimed in claim 3, wherein said tilted coupling seat including two side plates corresponding to each other and used to receive said rail therein.

5. The height adjusting device for use in a stringing machine as claimed in claim 4, wherein one of said side plates contains a micro-adjustable screw screwed therein, and another of said side plates involves an adjusting screw screwed therein.

6. The height adjusting device for use in a stringing machine as claimed in claim 5, wherein said micro-adjustable screw and said adjusting screw are in response to said biasing tabs of said sliding member individually.

* * * * *